United States Patent [19]

Yoshida

[11] Patent Number: 4,969,568

[45] Date of Patent: Nov. 13, 1990

[54] PEN STAND

[76] Inventor: Tsukasa Yoshida, 15-202 Nikko-danchi, 1-3 Nikko-cho, Fuchu, Shi, Tokyo, Japan

[21] Appl. No.: 838,501

[22] Filed: Mar. 11, 1986

[30] Foreign Application Priority Data

Mar. 29, 1985 [JP] Japan ..... 60-45059

[51] Int. Cl.[5] ..... B65D 1/24

[52] U.S. Cl. ..... 220/22.3; 220/22.1; 220/22.2; 220/23.4; 220/4 F; 403/171; 211/186; 211/189; 446/111; 446/112

[58] Field of Search ..... 206/214, 453, 504, 586, 206/821; 220/4 F, 23.4, 22, 22.1, 22.2, 22.3; 229/4.5, 5.7, 48 R, 49; 211/69.1, 72, 189, 186; 403/170, 171, 173; 24/570, 571; 446/111, 112, 113; 312/108, 111, 140

[56] References Cited

U.S. PATENT DOCUMENTS

| | | | |
|---|---|---|---|
| 1,281,856 | 10/1918 | Shaw | 211/189 |
| 1,398,852 | 11/1921 | Gilbert | 446/112 |
| 1,426,087 | 8/1922 | Metcalfe | 446/112 |
| 2,100,773 | 11/1937 | Boeye | 229/5.7 |
| 2,178,778 | 11/1939 | Curry | 229/5.7 |
| 2,284,458 | 5/1942 | Van Antwerp | 446/112 |
| 3,069,216 | 12/1962 | Vaeth | 211/186 |
| 3,335,932 | 8/1967 | Brown | 206/453 |
| 3,716,936 | 2/1973 | Miller | 206/45.34 |
| 3,955,510 | 5/1976 | Kinik et al. | 312/108 |
| 4,069,927 | 1/1978 | Taylor | 206/821 |
| 4,195,729 | 4/1980 | Macken | 206/45.34 |
| 4,449,662 | 5/1984 | Okamura et al. | 229/49 |
| 4,493,425 | 1/1985 | Yoshida | 403/171 |
| 4,531,930 | 7/1985 | Clauss | 229/4.5 |
| 4,558,297 | 12/1985 | Mitchell | 220/4 F |

FOREIGN PATENT DOCUMENTS

| | | | |
|---|---|---|---|
| 1261528 | 1/1972 | United Kingdom | 446/111 |
| 2033044 | 5/1980 | United Kingdom | 403/170 |

*Primary Examiner*—David T. Fidei

*Attorney, Agent, or Firm*—Sughrue, Mion, Zinn, Macpeak & Seas

[57] ABSTRACT

A modular construction which is suitable for use as a pen holder is fabricated from a plurality of flat board members detachably connected to each other by connecting members having a plurality of wing pieces disposed at a suitable angle relative to each other and provided with board member receiving grooves. The board members and connecting members may be assembled into a holder having at least one tubular compartment having a bottom member detachably secured therein. The shape of the various compartments can be varied by changing the angle between the wing pieces of the connecting members and some connecting members may be provided with upwardly and downwardly opening grooves for assembling a two tiered structure of board members.

7 Claims, 7 Drawing Sheets

FIG. 1a
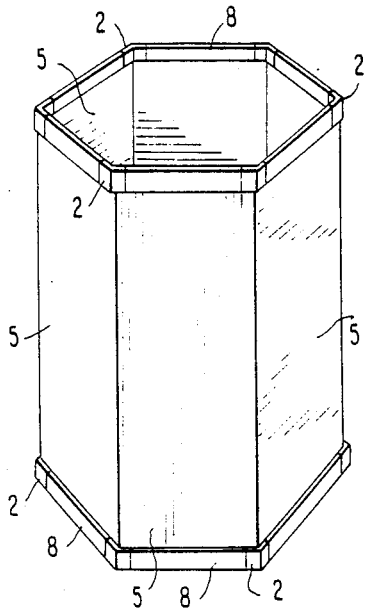
FIG. 1b
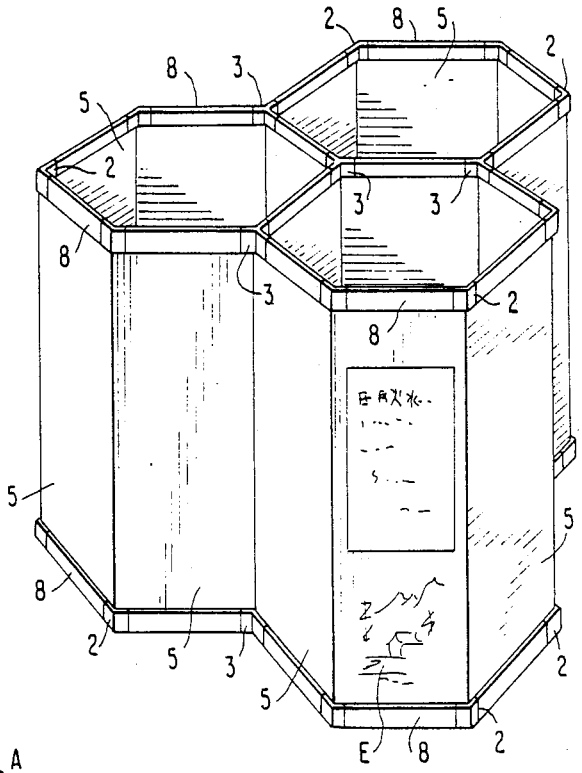
FIG. 2
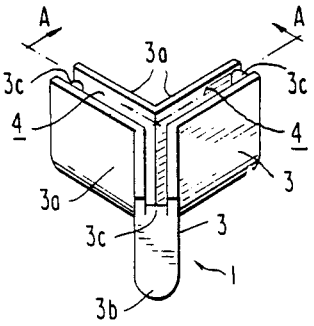
FIG. 3
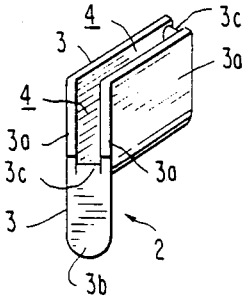
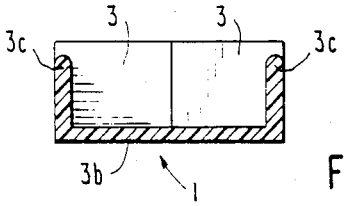
FIG. 4

FIG. 5
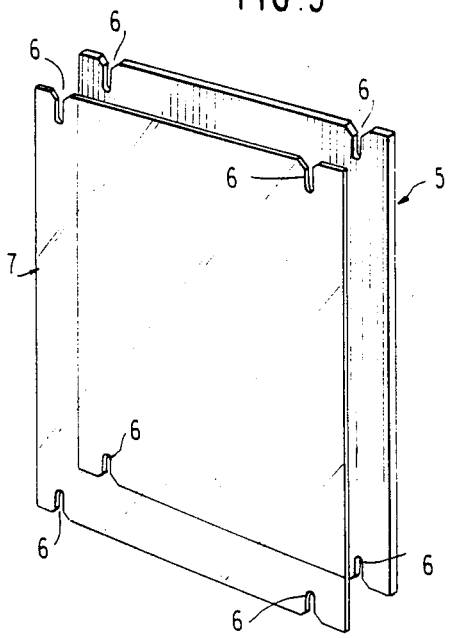
FIG. 6
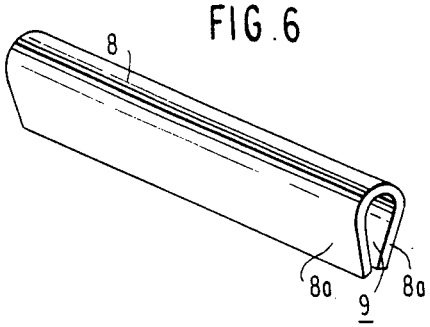
FIG. 9a
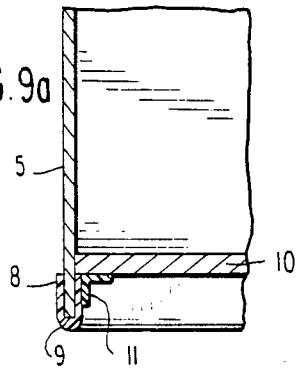
FIG. 7
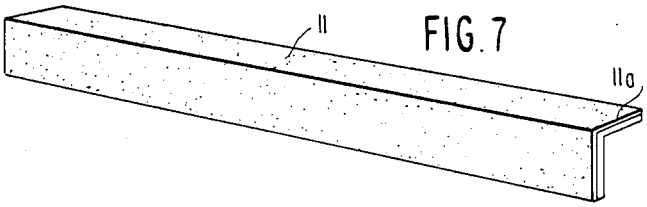
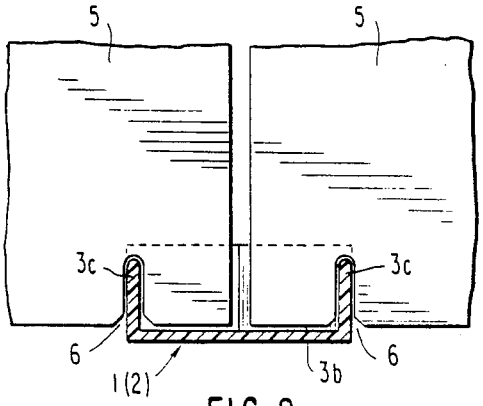
FIG. 8
FIG. 9b
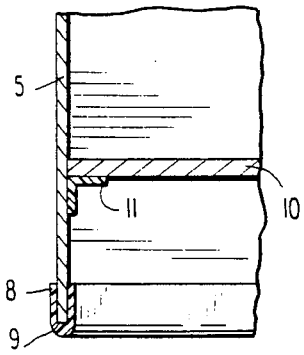

FIG. 11
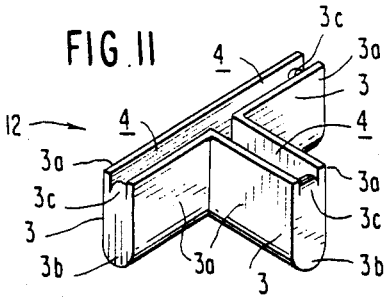
FIG. 12
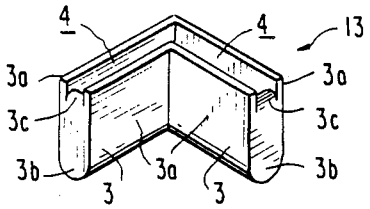
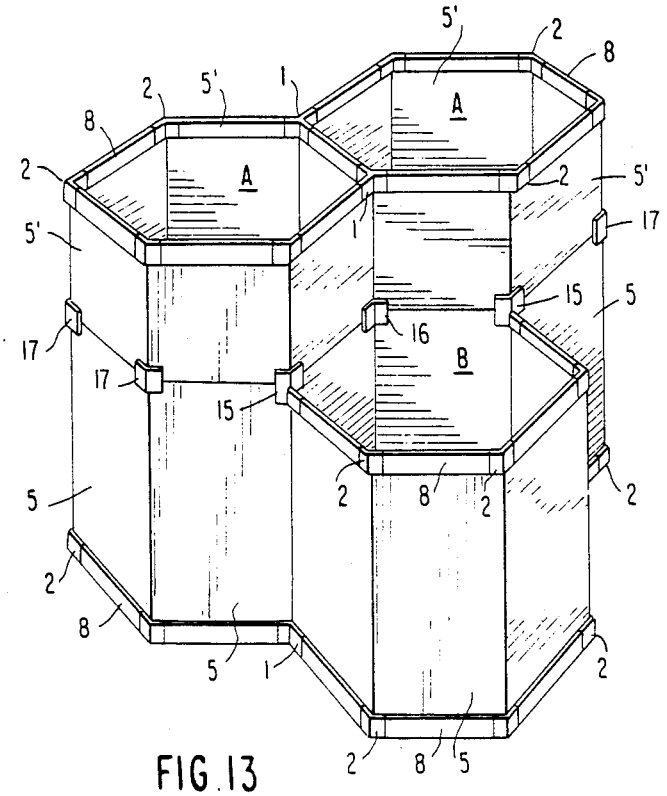
FIG. 13

FIG. 14
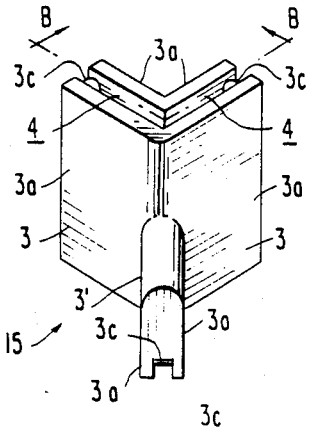
FIG. 15
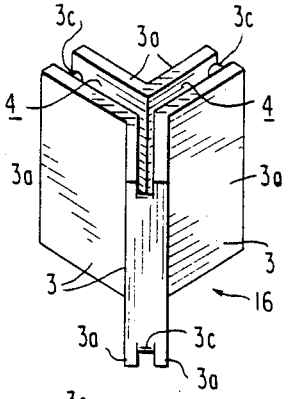
FIG. 16
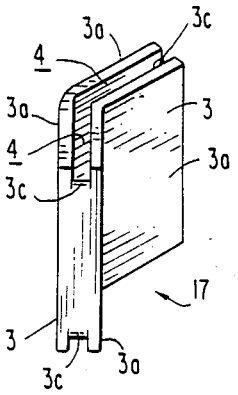
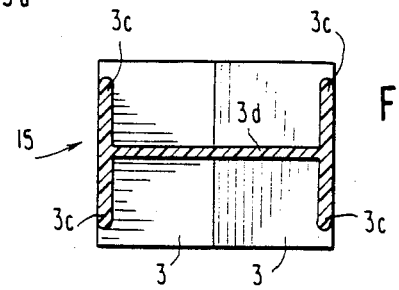
FIG. 17
FIG. 18a
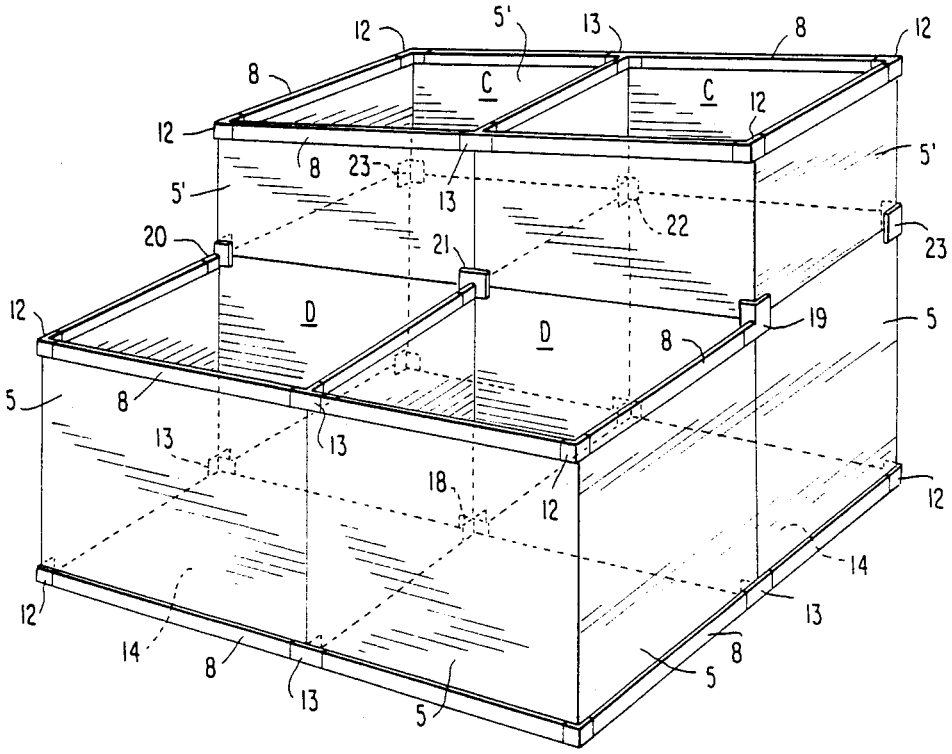

FIG.18b
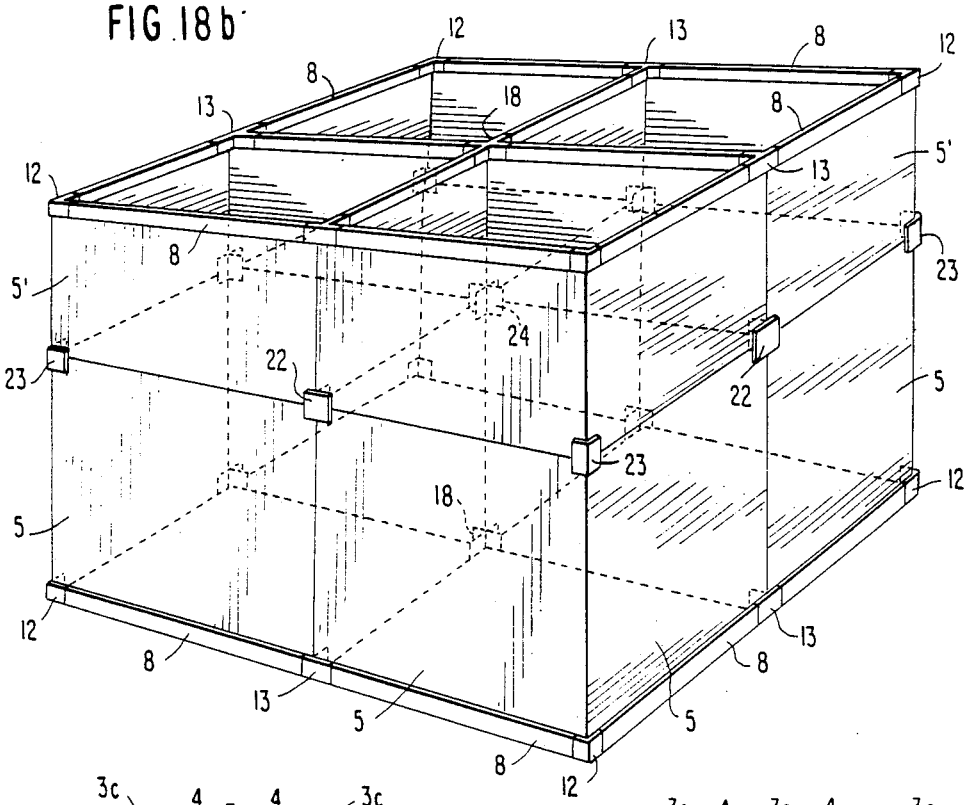
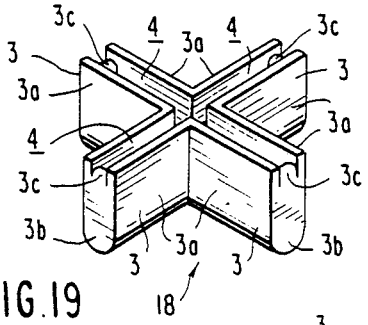
FIG.19
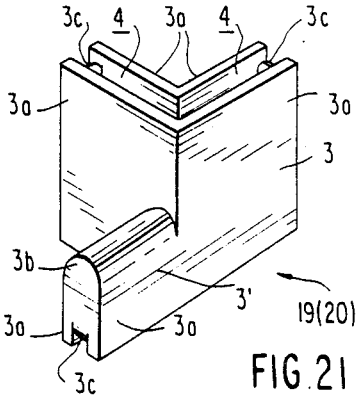
FIG.21
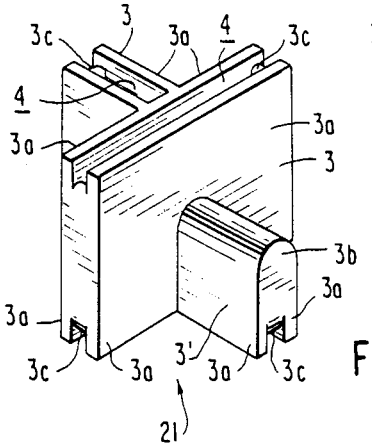
FIG.20

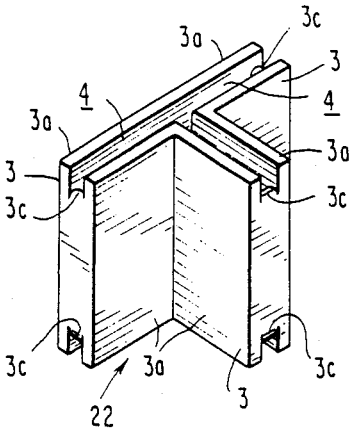
FIG. 22
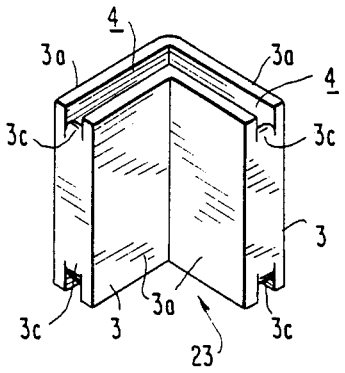
FIG. 23
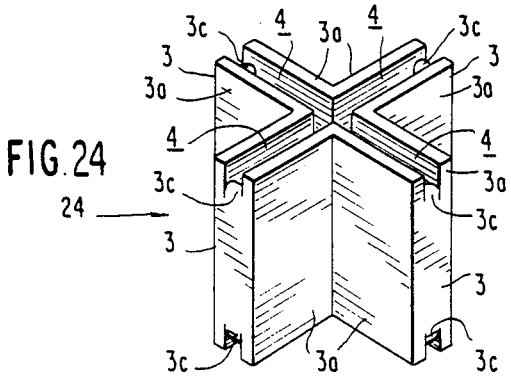
FIG. 24
FIG. 25
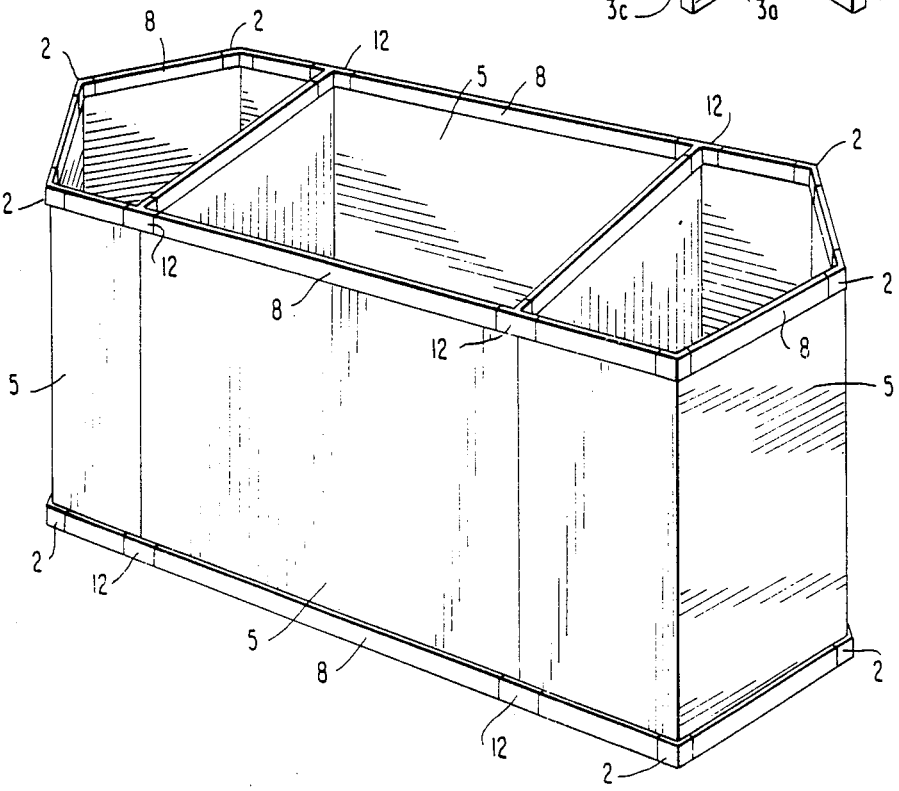

PEN STAND

BACKGROUND OF THE INVENTION

The present invention is directed to a pen stand and more specifically to an open top container adapted to rest on a desk or table for holding a plurality of pens, pencils, eraser brushes and the like.

Conventional pen stands are generally formed as single tubular bodies which are closed at the bottom and open at the top. However the number of pens and pencils which can be held in such a single tubular body is substantially limited by the diameter of the tubular body since the diameter must be sufficiently small in order to hold the pens and pencils in an upright position. Therefore a plurality of separate stands are generally required if a large number of pens and pencils are to be held. Furthermore when a large number of pens, pencils, and the like are placed in a single pen stand it is often difficult to quickly find the desired writing instrument in a quick and efficient manner. Once again a large number of separate pen stands are then required in an attempt to categorize the various writing instruments into desired groupings to facilitate the selection of the desired writing instrument. Such a large number of individual pen stands or holders creates an unsightly clutter on a desk and the relative placement of the individual pen stands or holders with respect to each other can too easily be changed about thereby leading to confusion in selecting the desired instrument.

SUMMARY OF THE INVENTION

The pen stand or holder according to the present invention overcomes the aforementioned problems associated with individual separate pen and pencil holders by providing a single holder having a plurality of individual compartments the number of which can readily be increased or decreased.

The pen stand or holder according to the present invention is fabricated from a plurality of flat rectilinear board members which are detachably connected to each other by means of a plurality of straight or angularly related connecting members having grooves therein for detachably engaging the corners of adjacent board members to assemble the board members into a single multisided compartment or a plurality of contiguous multisided compartments which may be of equal or different height with respect to each other. A bottom member having a configuration complementary to the configuration of the pen stand is disposed within the pen stand in engagement with the upper surface of the connecting members or at any intermediate location between the top and bottom of the compartment by means of L-shaped adhesive supports.

The foregoing and other objects, features and advantages of the invention will be apparent from the following more particular description of a preferred embodiment of the invention as illustrated in the accompanying drawings.

BRIEF DESCRIPTION OF THE DRAWINGS

FIG. 1*a* is a perspective view of a pen holder according to a first embodiment having a single hexagonal compartment;

FIG. 1*b* is a perspective view similar to FIG. 1*a* wherein the pen holder is provided with a plurality of contiguous hexagonal compartments;

FIG. 2 is a perspective view of a connecting member for joining three board members at equal angles to each other;

FIG. 3 is a connecting member for joining two board members at an angle to each other;

FIG. 4 is a sectional view taken along the line A—A of FIG. 2;

FIG. 5 is an exploded perspective view of a board member and a transparent plate;

FIG. 6 is a perspective view of an edge frame member;

FIG. 7 is a perspective view of a bottom board support member;

FIG. 8 is a partial longitudinal sectional view showing the connective relationship of two adjacent board members and a connecting member;

FIG. 9*a* is a partial longitudinal sectional view showing the bottom board mounted in a first position in contact with the connecting member;

FIG. 9*b* is a partial longitudinal sectional view similar to FIG. 9*a* showing the bottom board mounted in a second position above the connecting member;

FIG. 11 is a perspective view of one type of connecting member for use with the embodiment of FIG. 10;

FIG. 12 is a perspective view of another type of connecting member for use with the embodiment of FIG. 10;

FIG. 13 is a perspective view of a third embodiment according to the present invention showing a pen holder having a plurality of compartments of different heights;

FIG. 14 is a perspective view of one type of connector for use with the embodiment of FIG. 13;

FIG. 15 is a perspective view of another type of connector for use with the embodiment of FIG. 13;

FIG. 16 is a perspective view of still another type of connector for use with the embodiment of FIG. 13;

FIG. 17 is a sectional view taken along the line B—B in FIG. 14;

FIGS. 18*a* and 18*b* are perspective views of a fourth embodiment according to the present invention;

FIGS. 19–24 are perspective views of a plurality of different connectors useful with the embodiment of FIG. 18; and FIG. 25 is a perspective view of a fifth embodiment according to the present invention.

DETAILED DESCRIPTION OF THE INVENTION

Figure 10A:
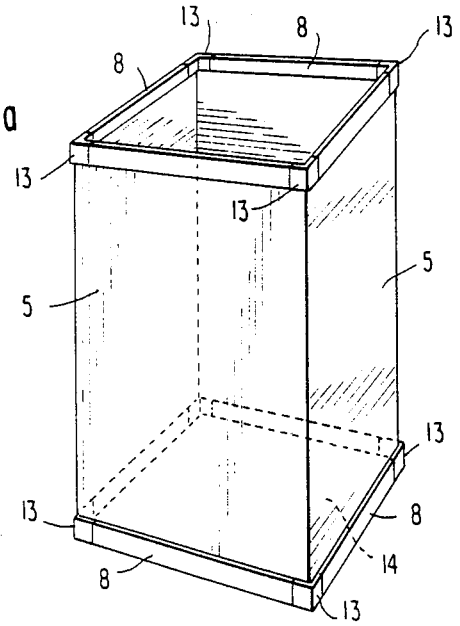
FIG. 10*a* is a perspective view of a second embodiment according to the present invention showing a pen stand having a single compartment having a rectangular configuration.

In the first embodiment according to the present invention as shown in FIGS. 1–9 the pen stand is fabricated from a plurality of board members which may be of synthetic resin material, cardboard or the like by using two different types of connecting members 1 and 2. Connecting member 1 is formed from three interconnected wing pieces 3 each of which has a U-shaped cross section. The wing pieces are disposed at 120° angles relative to each other and are each formed with a pair of vertically disposed parallel spaced apart support walls 3*a* interconnected by a base portion 3*b* having a curved bottom surface. The support walls 3*a* define an upwardly open groove 4. The grooves 4 intersect with each other at the apex of the angle between each wing piece and the outer ends of each groove 4 are partially closed by means of projection 3c which extends upwardly from the base portion with the upper end of the projection 3c being spaced from the top edges of the support walls 3a. The upper surface of the projection 3c is provided with a smooth and rounded edge to facilitate engagement of the projection in the notches 6 formed in the top and bottom edges of the board members 5 adjacent to but spaced from the side edges thereof. Each groove 4 has a width substantially equal to the width of the board 5 so as to provide a snug friction fit of the boards in the grooves. As shown in FIG. 5 the board member 5 may be used in conjunction with a transparent plate of synthetic resin material which would protect any design formed on the outer surface of the board 5. It is also contemplated that sheets of paper having a design thereon, a photograph, or calendar or the like may be inserted between the board 5 and the transparent plate 7. In this case the combined thicknesses of the board 5 and the plate 7 will be approximately equal to the width of the grooves 4 to provide a snug friction fit.

The connecting members 1 are used to connect three boards in equiangular relationship to each other as shown in FIG. 1b when assembling a multi-compartment pen stand. The connectors 2 are used to connect two adjacent boards to each other at an angle of 120°. The connectors 2 are used to form either a pen stand having a single compartment as shown in FIG. 1a or for completing the three compartments of the pen stand as shown in FIG. 1b. The same connectors 1 and 2 are used at the top of the boards by merely inverting the connectors. After the boards have been assembled into the desired relationship relative to each other to define one or more compartments the top and bottom edges of the boards may be protected or finished off by means of an edge frame member 8 as shown in FIG. 6. The edge frame member 8 has a substantially U-shaped cross section with the legs 8a being inclined toward each other from the bight of the U toward the free edges thereof to define a board receiving groove 9. The edge frame member 8 may be constructed of flexible, resilient plastic material or the like whereby the legs 8a may be spread apart to frictionally grip the top and bottom edges of a board which is inserted into the groove 9. The length of each edge member 8 should be such that the ends of the edge member closely abut the ends of the connecting members to provide smooth finished top and bottom edges for the pen stand.

A bottom board 10 having a configuration complementary to the hexagonal compartments is located within each compartment and is so dimensioned as to be in sliding contact with the board members 5 defining the walls of each compartment.

The bottom board 10 may rest directly on the upper edges of the connecting members 1 and 2 and the edge members 8 as shown in FIG. 9a. If there is an insufficient frictional fit between the bottom board 10 and the board members 5 an L-shaped bottom board fitting member as shown in FIGS. 7 and 9 may be used to adhesively secure the bottom board within the compartment. The fitting member 11 may have an adhesive double coated tape 11a secured to two surfaces thereof as shown in FIG. 7 whereby the horizontally disposed surface of the L-shaped fitting member may be adhesively secured to the under surface of the bottom board adjacent a straight edge portion thereof and the vertically disposed portion of the L-shaped fitting member may be adhesively secured to the edge member 8 as shown in FIG. 9a or adhesively secured to a board member 5 as shown in FIG. 9b if it is desired to locate the bottom board at some position intermediate the top and bottom end of the board members 5. While only a single L-shaped fitting member 11 is shown in FIG. 9 it is contemplated that a plurality of such fitting members would be used along a plurality of the edges of the bottom board 10.

Figure 10B:
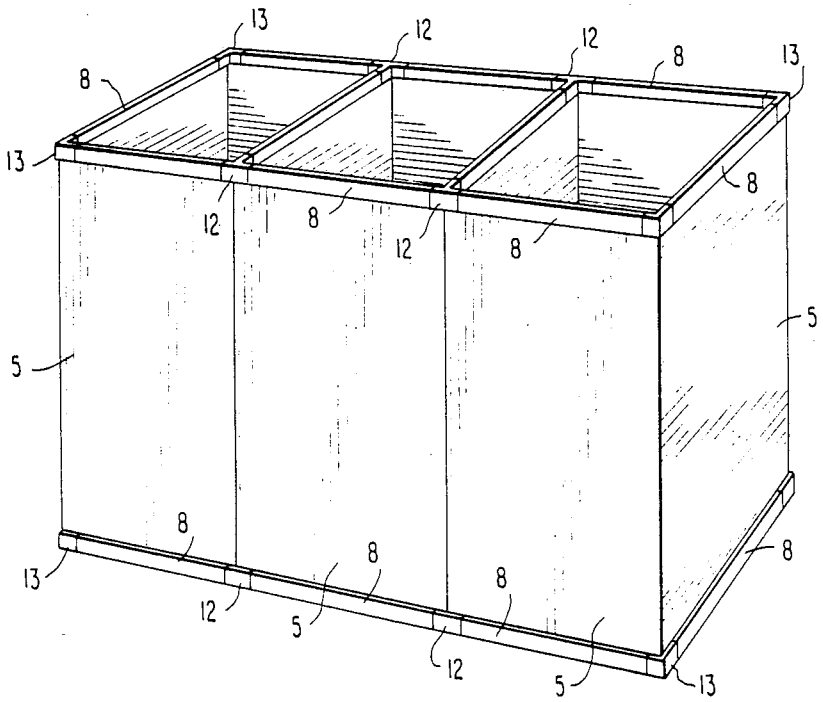
FIG. 10*b* is a perspective view similar to FIG. 10*a* showing a multi-compartment pen holder.

In the second embodiment of the present invention as shown in FIGS. 10–12 the compartment or compartments of the pen stand have a rectangular square configuration as opposed to the hexagonal configurations in the first embodiment. In this embodiment the board members 5, which may be identical to the board members used in the first embodiment, are connected together sequentially by connecting members 12 and 13 each of which has a plurality of wing pieces substantially identical to the wing pieces described above with respect to the connectors of the first embodiment. However in accordance with the embodiment of FIGS. 10–12 the connector 12 has a substantially T-shaped configuration and the connector has a pair of wings 3 disposed at right angles to each other. Thus the connectors 12 are used to assemble two board members 5 adjacent each other in a common plane with a third board member 5 disposed at right angles thereto. The connecting members 13 are used to connect two board members 5 at right angles to each other. The pen stand may have a single rectangular or square compartment as shown in FIG. 10a or may have a plurality of rectangular or square compartments of equal size as shown in FIG. 10b. Thus each compartment has a rectangular parallelepiped configuration. A bottom member 14 having a configuration complementary to the dimensions of the compartment may be provided in each compartment similar to the manner in which the bottom boards are secured in the previous embodiment. By using identical size rectilinear board members 5 each of these compartments will have a square cross sectional configuration. By using boards 5 having different widths different size compartments may be formed having a rectangular configuration.

A third embodiment of the present invention is shown in FIGS. 13–17 wherein the pen stand is provided with a plurality of hexagonal compartments as in the first embodiment but with at least one compartment having a different height from the remaining compartments. The connecting members 1 and 2, as viewed in FIG. 13, are identical to the connecting members 1 and 2 shown in detail in FIGS. 2 and 3. In order to achieve a greater height with respect to some of the compartments it is further necessary to utilize connecting elements 15, 16, and 17 as illustrated in FIGS. 14, 15, and 16, respectively.

The connecting member 15 is comprised of three wing pieces 3 which are disposed at an angle of 120° with respect to each other. Two of the wing pieces 3 are formed so that they are about twice as high as the connecting members 1 and 2 and an intermediate partition 3d, as shown in FIG. 17, is provided between the parallel spaced apart support walls 3a to define upwardly and downwardly open grooves 4, respectively, for receiving board members 5. The other wing piece 3' is constructed to be substantially identical to the wing pieces 3 of the fittings 1 and 2. The two upwardly open grooves 4 in the two wing members 3 communicate with each other and the three downwardly open grooves in the two wing members 3 and the third wing member 3' communicate with each other. The outer ends of each groove are provided with projections 3c similar to the projection 3c in the fittings 1 and 2 for engaging in the notches 6 in the top and the bottom edges of the board members 5.

The connecting member 16 as shown in FIG. 15 is comprised of three identical wing pieces 3 which are disposed at an angle of 120° with respect to each other. These wing pieces 3 are formed to be about twice as high as the connecting members 1 and 2 and a partition 3d is provided between the supporting wall 3a to define upwardly and downwardly opening grooves for receiving the boards 5. The upwardly opening grooves 4 all communicate with each other at the center point as do the downwardly opening grooves and projections 3c are provided at the outermost end of each groove for engaging in the grooves 6 and the board members 5.

The connecting member 17 as shown in FIG. 16 is provided with two wing members 3 disposed at an angle of 120° with respect to each other and which has upwardly and downwardly opening grooves 4 substantially identical to the grooves 4 shown in the connecting members 16.

By using the connecting members 1, 2, 15, 16, and 17 in conjunction with board members 5 which may be of equal or different heights it is possible to construct the pen stand as shown in FIG. 13 with the compartments A being higher than the compartment B. The lower board members 5 are connected to the fittings 1 and 2 to define three identical hexagonal compartments similar to the manner in which the compartments of the first embodiment are formed. However instead of using the connecting members 1 and 2 to secure the top corners of the boards 5 to each other a connecting member 16 is secured to the upper corners of the lower boards 5 at the common point between the two compartments. The connecting members 15 are secured to the upper edges of the lower panels 5 at the points of intersection between three compartments and the connecting members 17 are used to secure the upper corners of the lower board members 5 together where only two board members abut against each other. The upper board members 5', which are shown as being shorter than the lower board members 5 but which may be of any desired height, are then fitted into the upwardly opening grooves 4 of the connecting members 15, 16, and 17 and the top corners of the upper board members are secured together by means of the fittings 1 and 2. The exposed top and bottom edges of the board members 5 and 5' of all three compartments are then finished off with the edge fitting members 8. Thus a pen stand is provided with one compartment B being shorter than the other two compartments A.

In the fourth embodiment of the present invention as shown in FIGS. 18–24 a pen stand is provided having a plurality of parallelepiped compartments some of which are higher than others as shown in FIG. 18a or with all of the parallelepiped compartments being equal in height but being comprised of two tiers of board members 5 and 5'. In both of these arrangements a substantially square or rectangular pen holder is provided containing four contiguous compartments as opposed to the linear arrangement of the rectilinear compartments as shown in FIG. 10b. In order to accomplish this it is necessary to use the connecting members shown in FIGS. 19–24, respectively, in addition to the connecting members 12 and 13 described above in the embodiment of FIGS. 10–12.

The connecting member 18 as shown in FIG. 19 is in the form of a cross having four identical wing pieces 3 each of which is identical to the wing pieces described above with respect to the connecting member 1 shown in FIG. 2. The connecting member 18 is used as illustrated in FIGS. 18a and 18b to connect the bottom corner edges of four board members 5 and to connect together the top corner edges of four contiguous upper tier board members 5' as shown in FIG. 18b.

The connecting member 19, as shown in FIG. 21, is comprised of 3 wing pieces 3 two of which are identical to each other and are provided with upwardly and downwardly open grooves 4 disclosed at right angles to each other. The third wing 3' is only provided with a downwardly open groove and extends in alignment with one of the downwardly opening grooves of a wing three while being perpendicular to the downwardly opening groove of the other wing 3. The fitting 19 shown in FIG. 21 is substantially identical to the fitting shown in FIG. 14 with the exception of the angular orientation of the wing 3' relative to the orthogonally disposed wings 3. The connecting member 20 is substantially identical to the connecting member 19 but the wing member 3' extends perpendicular to the other wing member 3. The connecting members 19 and 20 are used as shown in FIG. 18a to connect the common corner edges of five contiguous board members 5.

Connecting member 21 as shown in FIG. 20 is comprised of three wing pieces 3 which are disposed perpendicular to each other and which are provided with upwardly and downwardly opening grooves and a fourth wing member 3' which is only provided with a downwardly opening groove 4. The four wing members are in the form of cross and are used to connect the adjacent corner edges of seven contiguous panels as shown in FIG. 18a.

The connecting member 22 as shown in FIG. 22 is substantially identical to the connecting member 21 with the exception that the wing member 3' is omitted. The connecting member 22 is used to connect the adjacent corner edges of six contiguous board members 5 together as shown in FIGS. 18a and 18b.

The connecting member 23 as shown in FIG. 23 is comprised of two identical wing members 3 disposed at right angles to each other with each wing member having upwardly and downwardly opening grooves 4 therein. The connecting member 23 is used to connect the adjacent corner edges of four contiguous board members 5 as shown in FIGS. 18a and 18b.

The connecting member 24 as shown in FIG. 24 is comprised of four identical wing members 3 in the form of a cross with each of the wing members having upwardly and downwardly opening grooves. The connecting member 24 is used to connect the adjacent corner edges of eight contiguous board members 5 as shown in FIGS. 18b.

As shown in FIGS. 18a and 18b the upper tier board members 5 have a different height than the lower tier of board members 5, but it is obvious that the heights of the two tiers could be equal or in any desired proportion relative to each other. The upper corner edges of contiguous panels are connected together by means of the connecting members 12 and 13 as well as the connecting member 18 as shown in FIG. 18b. The exposed top and bottom edges of the board members 5 are covered by the edge fitting members 8 to provide a finished pen holder construction.

In a fifth embodiment of the present invention as shown in FIG. 25 a pen stand is constructed using different size board members 5 and the connecting members 2 in combination with the connecting members 12 to provide a central rectangular parallelepiped compartment and two end compartments having angularly disposed end walls. In addition to the embodiments shown it is also contemplated that pen stands can be formed with compartments of any desired shape such as triangular or octagonal compartments by merely varying the angle between the wing pieces and the connecting elements. While only single and double tier constructions have been shown it is also contemplated that other multiple tier constructions could be carried out. In each of the embodiments, each compartment is provided with a bottom member having a configuration complementary to the configuration of the compartment which may be secured therein by the means shown in FIGS. 7 and 9.

Since the present device is fabricated from a plurality of board members which are detachably connected to each other by connecting members as described above a pen stand can be formed not only in a single body but also in a continuous body comprised of a plurality of compartments as the occasion demands. Therefore the present device makes it possible to dispose many different kinds of writing brushes, pens, pencils, etc., on a desk in a sorted and orderly manner to enable the quick easy selection of the desired instrument and to improve working efficiency. Moreover since the board members and the connecting members are connected together by a simple friction fit anyone can fabricate these members quickly and easily in order to increase the amount of compartments as the occasion demands. Likewise if any part of pen stand becomes unnecessary this part can easily be disassembled and stored in a convenient place. Since the members are free from wear and the manufacturing cost is relatively low due to the duplication of a large number elements the manufacturing procedures are extremely easy and the cost relatively low. The board members and the connecting members may be constructed of any desirable material and in each embodiment the board members may be either utilized alone or in combination with a transparent cover member.

While the invention has been particularly shown and described with reference to preferred embodiments thereof it will be understood by those in the art that the foregoing and other changes in form and details may be made therein without departing from the spirit and scope of the invention.

What is claimed is:

1. A modular construction suitable for use as a pen holder or the like comprising a plurality of flat rectangular board members, a plurality of connecting members for detachably connecting said board members to each other to define at least one elongated vertically disposed tubular compartment and a bottom member for closing one end of said compartment wherein each of said connecting members is comprised of a plurality of U-shaped wing pieces adapted to be disposed at an angle relative to each other with each U-shaped wing piece defining a board member receiving groove with the adjacent ends of each groove being disposed in communication with each other at the apex of the angle between said U-shaped wing pieces and the opposite end of said grooves being partially closed by a projection and wherein each of said board members is provided with a pair of notches in the top and bottom edges thereof in spaced relation from the side edges thereof for receiving said projections on said connecting members and edge members complimentary in shape and size to said U-shaped wing pieces detachably connected to the top and bottom edges of said board members intermediate said connecting members in abutting relation to U-shaped wing pieces at opposites ends of the edge members to define smooth finished top and bottom edges for the compartment, said bottom member being supported on said bottom edge within said compartment.

2. A modular construction as set forth in claim 1 further comprising a plurality of transparent cover members having the same size, configuration and notches as said board members disposed in the same grooves of said connecting members with respective board members.

3. A modular construction as set forth in claim 1 wherein said board members and said connecting members define a plurality of contiguous compartments having identical configurations.

4. A modular construction as set forth in claim 3 wherein said connecting members include connecting members having wing pieces disposed at an angle of 120° relative to each other to define when assembled with said board members a plurality of compartments having hexagonal configuration.

5. A modular construction as set forth in claim 3 wherein all of said connecting members have wing pieces disposed at right angles to each other to define when assembled with said board members a plurality of rectangular parallelepiped compartments.

6. A modular construction as set forth in claim 1 wherein said connecting members include intermediate connecting members having U-shaped wing portions with upwardly and downwardly opening grooves for constructing at least one compartment having upper and lower tiers of board members.

7. A modular construction as set forth in claim 6 wherein at least two intermediate connecting members secured between said adjacent tiers of board members have a greater number of U-shaped wing members with downwardly opening grooves than the number of U-shaped wing members having upwardly opening grooves for securing boards of a single tier compartment adjacent said lower tier of boards.

* * * * *